US006064845A

United States Patent [19]

Suzuki

[11] Patent Number: 6,064,845

[45] Date of Patent: May 16, 2000

[54] CHARGE WIRE FOR IMAGE FORMING DEVICE

[75] Inventor: Tsuyoshi Suzuki, Owariasahi, Japan

[73] Assignee: Brother Kogyo Kabushiki Kaisha, Nagoya, Japan

[21] Appl. No.: 09/057,442

[22] Filed: Apr. 9, 1998

[30] Foreign Application Priority Data

Apr. 10, 1997 [JP] Japan ..... 9-092020

[51] Int. Cl.[7] ..... G03G 15/02

[52] U.S. Cl. ..... 399/170; 361/225; 250/324

[58] Field of Search ..... 399/168, 170, 399/171, 172, 311, 312, 313, 314, 315, 316; 361/225, 230, 235; 250/324, 325, 326

[56] References Cited

U.S. PATENT DOCUMENTS

| | | | |
|---|---|---|---|
| 3,942,006 | 3/1976 | Hayne . | |
| 4,837,658 | 6/1989 | Reale | 361/230 |
| 5,790,926 | 8/1998 | Mizoe et al. | 399/174 |

*Primary Examiner*—Richard Moses
*Attorney, Agent, or Firm*—Oliff & Berridge, PLC

[57] ABSTRACT

A charge unit 26 includes a charge wire 71. The wire 71 has a wire body 71A and a layer 82 coated on the outer peripheral surface of the wire body 71A. The layer 82 is formed from a cellulose resin binder 81 in which is dispersed particles of electrically conductive molybdenum disulfide. The charge unit 26 is used for forming a uniform charge on the surface of a photosensitive drum 25 in a process unit 7 of a laser printer 1.

21 Claims, 5 Drawing Sheets

CHARGE WIRE FOR IMAGE FORMING DEVICE

BACKGROUND OF THE INVENTION

1. Field of the Invention

The present invention relates to a charge wire, a method of manufacturing the charge wire, a charge device including the charge wire, and an image forming device including the charge device. The charge wire is for charging an object to be charged such as a photosensitive drum and is used in image forming devices for forming images such as by electrophotographic techniques.

2. Description of the Related Art

There have been known electrophotographic image forming devices, such as laser printers, including a charge unit, a photosensitive drum on which a desired image is to be supported, a laser beam scanner, a developing unit, a transfer unit, and a fixing unit. First, the charge unit charges the surface of the photosensitive drum to a uniform charge. Then, the laser beam scanner irradiates the surface of the photosensitive drum with light corresponding to a desired image. This forms an electrostatic latent image on the surface of the photosensitive drum corresponding to the desired image. Next, the developing unit develops the electrostatic latent image with toner to form a visible image. The transfer unit then transfers the visible toner image onto a transfer member such as a paper sheet. Finally, the fixing unit fixes the toner image onto the sheet.

Various types of charge units are available for charging the surface of the photosensitive drum. For example, corotoron charge units and scorotoron charge units are known. Both corotoron and scorotoron charge units include a C-shape shield and a wire stretched taut within the shield. The charge wire is made from tungsten steel from 60 $\mu$m to 100 $\mu$m. In scorotoron charge units, a grid having control electrodes is disposed at the open side of the shield. A high voltage is developed between the wire and the shield so that a corona discharge occurs.

However, a problem exists in corotoron and scorotoron charge units. As image forming processes are repeatedly performed, products resulting from the discharge process cling to the surface of the charge wire. Substances clinging to the charge wire include mainly silicon. A portion of the silicon component clinging to the charge wire is presumed to be from toner from the developing unit and rubber from developing rollers in the developing unit. Another portion of the silicon component is presumed to be from silicon used in the structure of the printer that has oxidized on the charge wire by energy produced during discharge.

SUMMARY OF THE INVENTION

The present inventor has observed that at first, such materials clinging to the surface of the charge wire cause no problem. However, as the amount of material clinging to the charge wire increases, variation is observed in charge produced on the photosensitive drum by the charge wire. The present inventor assumes that because the clinging material has electric insulating properties, a larger voltage develops at the surface of thicker areas of the clinging materials. Because a high voltage develops at the thicker areas and because the surface of thicker areas is also closer to the photosensitive drum, arc discharges spontaneously generate at the thicker areas. These discharges make it impossible to uniformly charge the surface of the photosensitive drum. As a result, quality of resultant images decreases.

It is concievable to use a wiper made of synthetic leather, for example, to wipe off materials clinging to the surface of charge wires. However, such maintenance operations for wiping off materials clinging to the charge wire would have to be frequently performed, either periodically to prevent poor quality images or each time poor quality images are observed.

Further, merely wiping the charge wire would not sufficiently clean the surface of the charge wire. It is conceivable to polish the surface of the charge wire using abrasive materials during cleaning maintenance. However, in this case, although the surface of the charge wire can be sufficiently cleaned of oxidation products and clinging materials, the life of the charge wire would be reduced proportionally to the number of times the discharge wire is polished to remove such materials.

It is also concievable to treat the charge wire so that the surface of the charge wire is prevented from oxidizing. For example, gold or platinum layer could be formed on the surface of the charge wire using plating or sputtering techniques. However, using such techniques to prevent oxidation of the charge wire would greatly increase the cost of the charge wire. Also, defective discharges could not be prevented.

It is an objective of the present invention to overcome the above-described problems and to provide a charge wire, a method of manufacturing the charge wire, a charge unit including the charge wire, and an image forming device including the charge unit, wherein the charge wire can sufficiently function as a charge wire even when certain amount of material clinging to the surface of the charge wire and wherein maintenance cycle and life of the charge wire can be greatly increased.

To achieve the above-described objectives, a charge wire according to a first aspect of the present invention includes a charge wire body having an outer peripheral surface; and particles of a conductive material provided to the outer peripheral surface of the charge wire body.

Although the particles can be formed from any conductive material, it is desirable that the particles be formed from molybdenum disulfide, because this material is relatively inexpensive and easy to obtain.

Although the particles can be provided directly on the surface of the charge wire body, it is desirable that the particles be dispersed in a dispersion medium coated on the surface of the charge wire body. A preferable dispersion medium is a cellulose type resin. The dispersion medium could alternatively be an acrylic resin, a fat, or an oil. It is preferable that the thickness of the dispersion medium/particle coating be regulated so that the diameter of the coating plus the diameter of the charge wire body is equal to or less than twice the diameter of the charge wire body alone.

According to a second aspect of the present invention, a method of producing a charge wire includes the steps of: dispersing particles of a conductive material in a dispersion medium; and coating the dispersion medium and the particles dispersed therein on an outer peripheral surface of a charge wire body.

According to a third aspect of the present invention, a charge device includes: a shield having an elongated shape substantially C-shaped in cross section and open at one side of the C shape; and the charge wire according to the above-described first aspect of the present invention, wherein the charge wire is stretched taut within the shield following the elongated shape.

According to fourth aspect of the present invention, an image forming device includes: a photosensitive drum disposed rotatable in a predetermined direction; the charge unit according to the above-described third aspect of the present invention, wherein the charge unit is for charging an area on a peripheral surface of the photosensitive drum to a uniform charge; a scanner unit for emitting light to form an electrostatic latent image in the uniformly charged area of the photosensitive drum; a developing unit for developing the electrostatic latent image with a developing agent into a visible developing agent image; a recording medium transport unit for transporting a recording medium past the photosensitive drum; and a transfer unit for transferring the developing agent image onto the recording medium as it is transported past the photosensitive drum by the recording medium transport unit.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
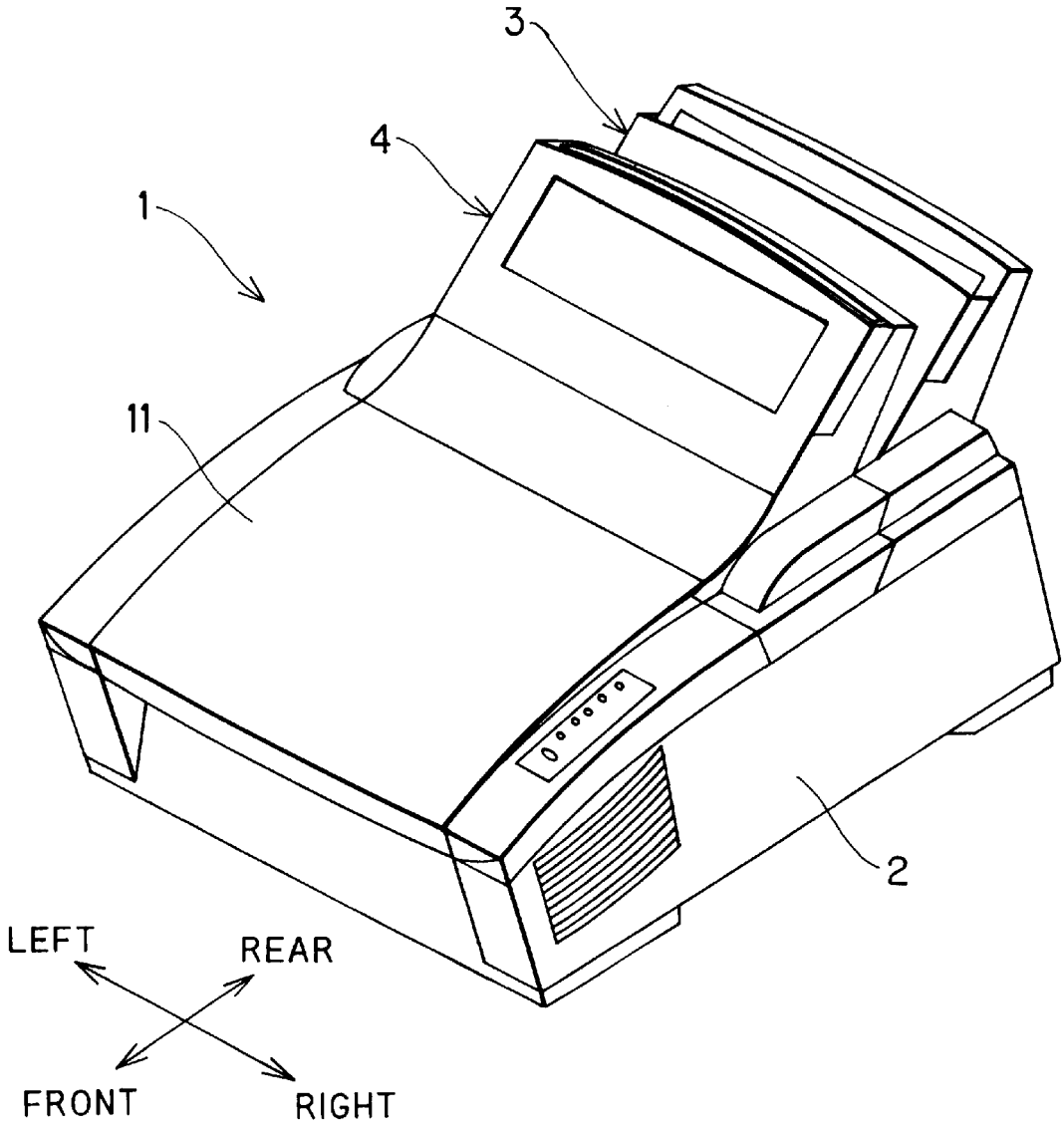
FIG. 1 is a perspective view showing a printer according to an embodiment of the present invention.

A laser printer 1 according to a preferred embodiment of the present invention will be described while referring to the accompanying drawings wherein like parts and components are designated by the same reference numerals to avoid duplicating description.

Figure 2:
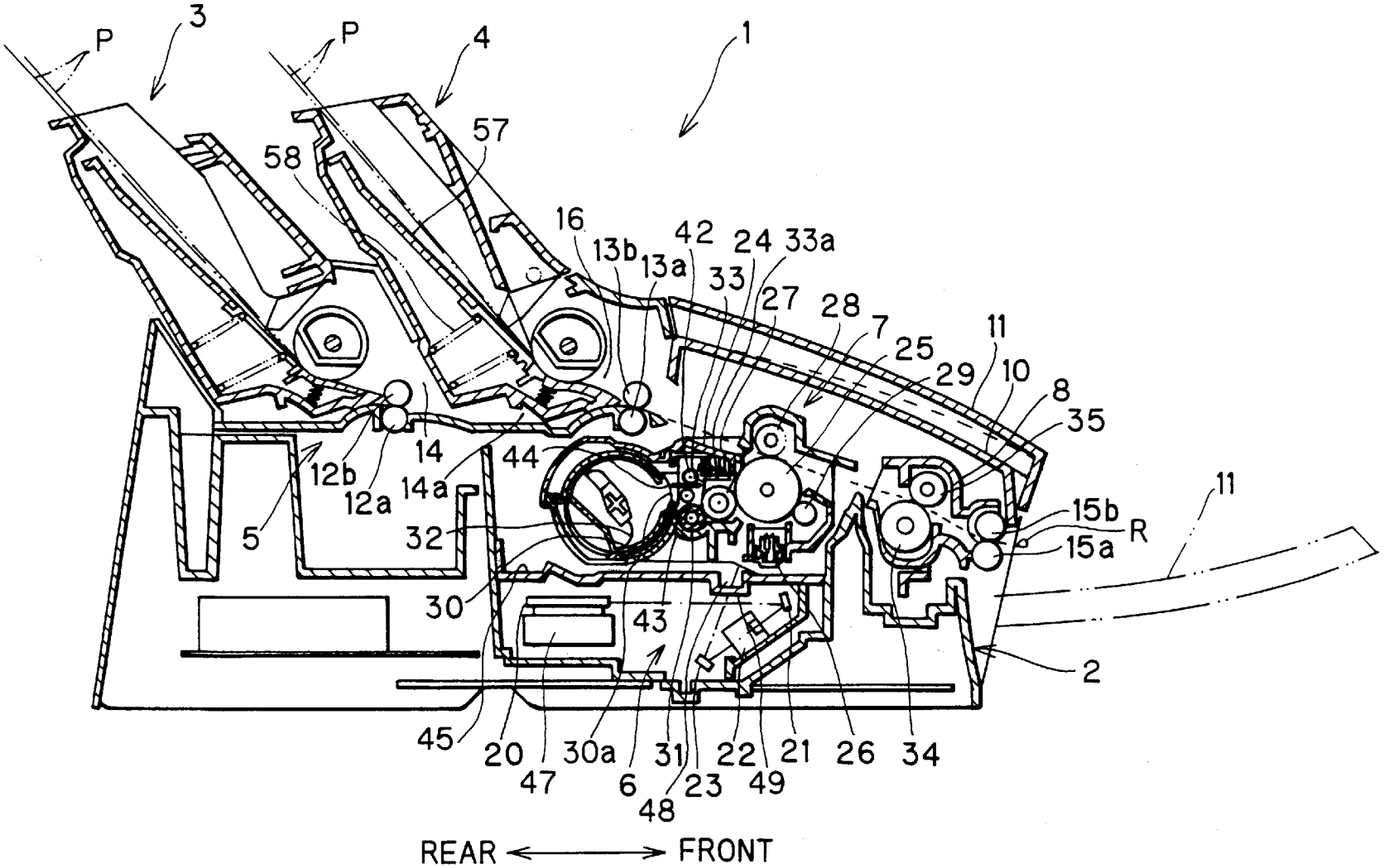
FIG. 2 is a cross-sectional view showing the printer of FIG. 1.

FIGS. 1 and 2 show the laser printer 1 according to the present embodiment. FIG. 1 is a perspective view showing the laser printer 1. FIG. 2 is a cross-sectional view showing the laser printer 1.

As shown in FIG. 1, the laser printer 1 includes a main case 2 and first and second sheet supply tray units 3, 4 provided at the rear portion of an upper surface of the main case 2. As shown in FIG. 2, the laser printer 1 further includes a sheet transport mechanism 5, a scanner unit 6, a process unit 7, and a fixing unit 8, all housed within the main case 2. The process unit 7, the scanner unit 6, and the fixing unit 8 function as an image forming portion for recording images. Although not shown in the drawings, a drive unit is housed in the left-front end of the main case 2. The drive unit is for driving the first and second sheet supply tray units 3, 4, the sheet transport mechanism 5, the process unit 7, and the fixing unit 8.

The first sheet supply tray unit 3 is fixedly provided to the upper surface of the main case 2 near a rear edge of the main case 2. The second sheet supply tray unit 4 is detachably provided at the upper surface of the main case 2 in front of the first sheet supply tray unit 3.

The sheet transport mechanism 5 is for transporting to the process unit 7 sheets that are selectively supplied from the first or second sheet supply tray units 3, 4 and includes a pair of feed rollers 12*a*, 12*b* provided at a lower edge of the first sheet supply tray unit 3 and a pair of resist rollers 13*a*, 13*b* provided at a forward lower edge of the second sheet supply tray unit 4. The feed roller 12*a* is positively driven to drive rotation of the feed roller 12*b*. Similarly, the resist roller 13*a* is positively driven to drive rotation of the resist roller 13*b*. The resist rollers 13*a*, 13*b* are for performing a resist operation on sheets before transporting the sheets to the process unit 7. During resist operations, the resist rollers 13*a*, 13*b* align the front edge of a supplied sheet in the direction perpendicular to the transport direction to correct sheets supplied at a slant.

A sheet transport pathway 14 extends from the first sheet supply tray unit 3 to the resist rollers 13*a*, 13*b* and includes a lower surface transport pathway 14*a* extending under and following the lower surface of the second sheet supply tray unit 4. The lower surface transport pathway 14*a* can be exposed by detaching the second sheet supply tray unit 4 from the main case 2.

Sheets supplied from the first sheet supply tray unit 3 are fed by the drive force of the feed rollers 12*a*, 12*b* through the lower surface transport pathway 14*a* to the resist rollers 13*a*, 13*b*. The second sheet supply tray unit 4 supplies sheets directly to the resist rollers 13*a*, 13*b*. The resist rollers 13*a*, 13*b* subject supplied sheets to resist operations and transport the correctly aligned sheets to the process unit 7 afterward.

Details of the process unit 7 will be described while referring to FIG. 3. The process unit 7 includes a casing 24 disposed at a predetermined position in the main case 2. The casing 24 houses components of the process unit 7 in a detachable cartridge configuration.

Components of the process unit 7 housed in the casing 24 include a photosensitive drum 25 having a photoconductive layer at its outer the surface; a charge unit 26, such as a scorotoron type charge device, disposed below the photosensitive drum 25; a developing device disposed upstream from the photosensitive drum 25 with respect to the sheet-supply direction, that is, to the left of the photosensitive drum 25 as viewed in FIG. 3; a detachable toner cartridge 30 for storing toner disposed upstream from the developing unit; a transfer roller 28 disposed to contact the surface of the photosensitive drum 25 from above; and a cleaning roller 29 disposed downstream form the photosensitive drum 25 with respect to the sheet-feed direction. The charge unit 26 is for developing a charge layer on the other peripheral surface of the photosensitive drum 25

The toner cartridge 30 includes an agitating body 32 for preventing the toner in the toner cartridge 30 from clumping together. A toner supply port 30*a* is formed from a hole in the substantial center of the toner cartridge 30 and a hole formed in the casing 24.

The developing device includes a developing roller 27 formed from a resilient rubber material, a toner supply roller 31, upper and lower screw-feed rollers 42, 43, and a partition plate 44 disposed between the screw-feed rollers 42, 43. The developing roller 27, the toner supply roller 31, the upper and lower screw-feed rollers 42, 43, an the partition plate 44 are housed in a portion of the casing 24 referred to as a developing chamber of the developing device.

The screw-feed rollers 42, 43 are rotatably disposed. The partition plate 44 extends in a direction parallel with rotational axis of the screw feed rollers 42, 43. The lower screw-feed roller 43 is for transporting toner supplied from the toner cartridge 30 through the toner supply port 30*a* toward end portions of the toner supply roller 31 from above the toner supply roller 31. The upper screw-feed roller 42 transports toner from ends of the toner supply roller 31 toward the toner supply port 30*a*. The partition plate 44 promotes the function of the upper screw-feed roller 42.

With this configuration, toner supplied to the developing chamber from the toner supply port 30*a* is circulated above the toner supply roller 31 in both directions to and from the toner cartridge 30 by the screw feed rollers 42, 43. Toner while circulatingly transported in this manner clings to the toner supply roller 31, whereupon it is supplied to and clings to the developing roller 27.

A blade 33 is fixed to a lower surface of the casing 24 above the developing roller 27. An L-shaped blade fixing member 33*a* is provided for fixing the blade 33 to the casing 24. The blade 33 charges toner supplied from the toner supply roller 31 onto the developing roller 27 to a predetermined polarity and also regulates thickness of the layer of toner on the developing roller to a predetermined thickness.

As shown in FIG. 2, the scanner unit 6 is disposed beneath the process unit 7. A scanner cover 45 is disposed above the scanner unit 6 and is interposed between the scanner unit 6 and the process unit 7. The scanner cover 45 is fixed at a position to cover almost all open portions upstream in the sheet-feed direction from a bottom plate portion 46 of the main case 2. An elongated scanner hole 48 extending in a direction parallel to the rotational axis of the photosensitive drum 25 is formed in the scanner cover 45. A glass plate 49 is fitted in the scanner hole 48.

Next, an explanation will be provided for the scanner unit 6. The scanner unit 6 is disposed beneath the scanner cover 45 and includes a well-known laser optical system having a scanner motor 47, a polygon mirror 20, a lens 22, and reflection mirrors 21, 23. Although not shown in drawings, the scanner unit 6 includes a laser emission portion such as a semiconductor laser below the scanner cover 45. The scanner unit 6 emits laser light and, using the laser optical system, scans the laser light based on inputted image data desired to be recorded to form the electrostatic latent image on the surface of the photosensitive drum 25. The emitted laser light travels through the glass plate 49 fitted in the scanner hole 48 and irradiates the outer peripheral surface of the photosensitive drum 25 to expose and form an electrostatic latent image on the outer peripheral surface of the photosensitive drum 25 according to the inputted image data.

The fixing unit 8 includes a heat roller 34, a pressing roller 35 pressing against the heat roller 34, and a pair of discharge rollers 15*a*, 15*b* disposed downstream from the heat roller 34 and the pressing roller 35. The pair of discharge rollers 15*a*, 15*b* are for discharging the sheet P out of the main case 2.

A top cover 10 and a discharge tray 11 are provided on the upper surface at the front end of the main case 2. The top cover 10 is openable to expose the components housed within the main case 2. The discharge tray 11 is switchable between a closed position indicated by a solid line in FIG. 2 and an open position indicated by a two-dot chain line in FIG. 2. When the discharge tray 11 is in its open position, the discharge tray 11 serves as a tray for receiving and accumulating sheets which have been printed on and discharged from the printer 1.

Next, operations of the image forming portion of the laser printer 1 will be described. A pathway R of the sheet P from the resist rollers 13*a*, 13*b* in the sheet-feed direction downstream to the discharge tray 11 is indicated in FIG. 2 by a broken line. First, the charge unit 26 develops a charge layer on the outer peripheral surface of the photosensitive drum 25. The scanner unit 6 then emits and scans a laser beam so as to irradiate the other peripheral surface of the photosensitive dram 25 according to image data to be recorded and form an electrostatic latent image in the charge layer.

The agitating body 32 in the toner cartridge 30 agitates toner in the toner cartridge 30 and pushes the toner out through the toner supply port 30*a*. Toner from the toner supply port 30*a* is supplied by the toner supply roller 31 to the outer peripheral surface of the developing roller 27. The blade 33 regulates thickness of the toner on the outer peripheral surface of the developing roller 27 to a predetermined thickness. Toner on the developing roller 27 is supplied to and clings to the electrostatic latent image formed on the photosensitive drum 25 by the laser optical system of the scanner unit 6 so that the electrostatic latent image is developed by the toner into a visible toner image. The toner image corresponding to the electrostatic latent image formed on the photosensitive drum 25 by the process unit 7 is transferred from the photosensitive drum 25 onto a sheet supplied to the process unit 7 and passing between the photosensitive drum 25 and the transfer roller 28. Next, the sheet P with the toner image thereon is transported to the fixing unit 8. The fixing unit 8 heats the toner transferred on the sheet P and fixes the toner on the sheet P.

Toner remaining on the photosensitive drum 25 is removed from the photosensitive drum 25 electrically by the cleaning roller 22 and is temporarily born on the surface of the cleaning roller 22. Afterward at a predetermined timing, wherein recording of an image on a sheet P is not performed, for example, between a transported sheet P and a subsequent transported sheet P, the toner on the outer peripheral surface of the cleaning roller 22 in electrically returned to the photosensitive drum 25 and then collected by the developing roller 27 and returned in the developing chamber.

Figure 3:
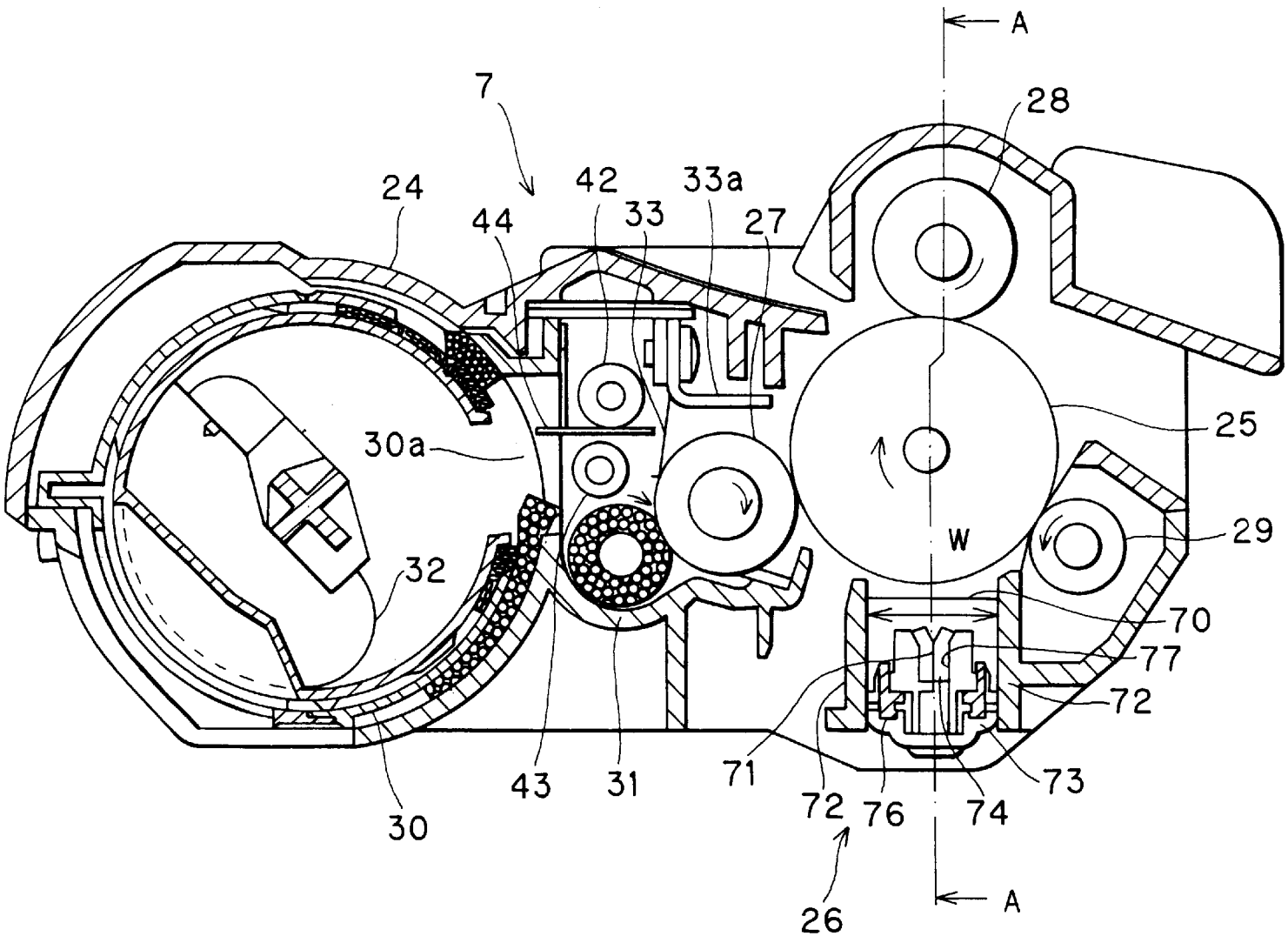
FIG. 3 is an enlarged view of FIG. 2 showing details of a process unit of the printer.
Figure 4:
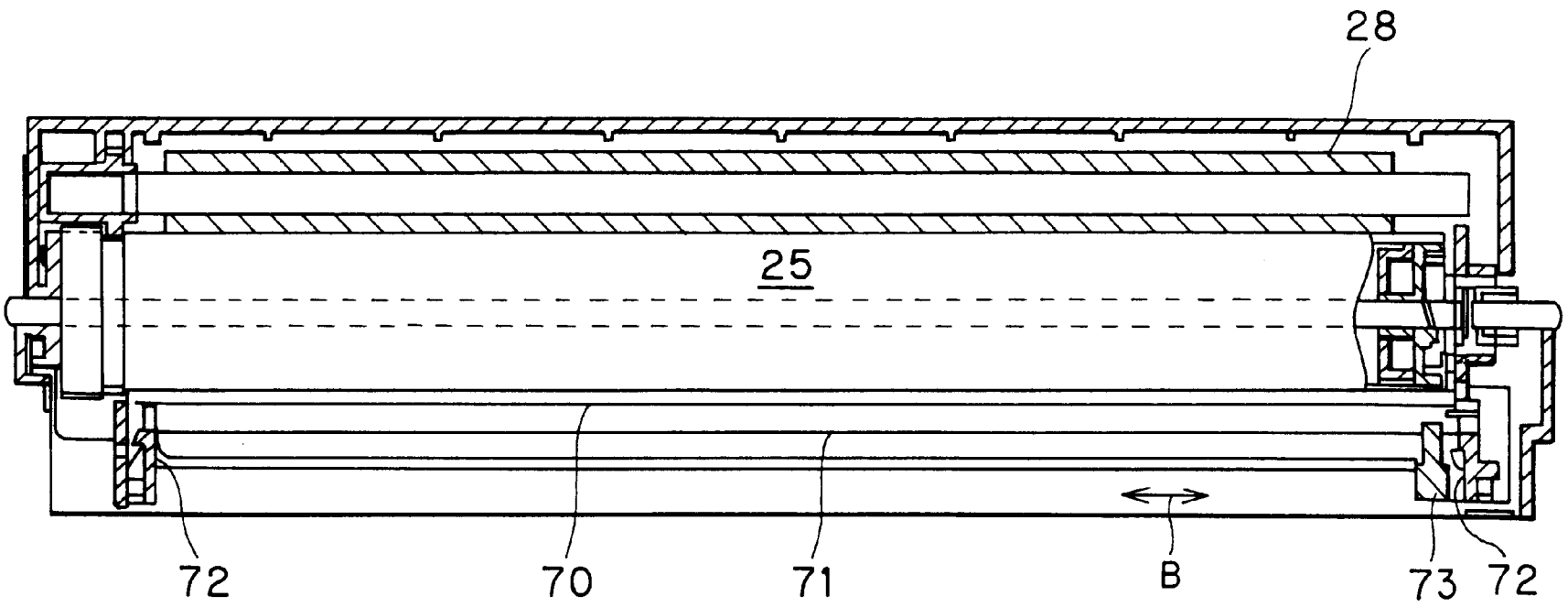
FIG. 4 is a cross-sectional view taken along line A—A of FIG. 3.
Figure 5:
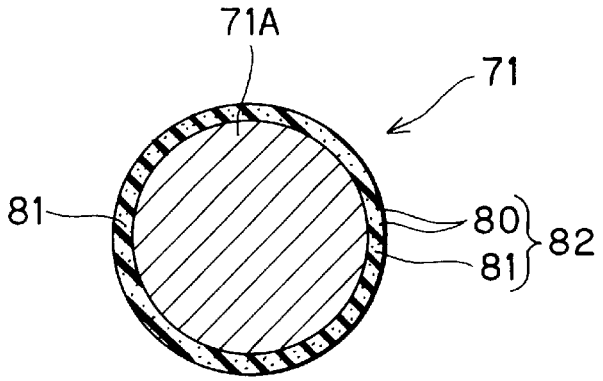
FIG. 5 is a cross-sectional view showing details of a charge wire used in the processing unit of FIG. 3.

Further explanation of the process unit 7 will be provided while referring to FIGS. 3 to 5. FIG. 3 is an enlarged view of FIG. 2 showing essential portions of the process unit 7. FIG. 4 is a cross-sectional view taken along line A—A of FIG. 3. The process unit 7 performs reverse development by impression development using non-magnetic component toner.

During image forming processes, the agitation body 32 agitates and supplies toner in the toner cartridge 30 through the toner supply port 30*a*. Operation of the screw feed rollers 42, 43 and the partition plate 44 distributes toner from the toner supply port 30*a* substantially uniformly to the toner supply roller 31 in the axial direction of the toner supply roller 31. Toner on the surface of the toner supply roller 31 is supplied to the developing roller 27. The toner supply roller 31 and the developing roller 27 are rotated in the same direction and so move in opposite directions at their position of contact. Because of this contact and contact by the blade 33, toner is charged to a predetermined polarity before being supplied to the developing roller 27.

The charge unit 26 charges the surface of the photosensitive drum 25 to a predetermined electric potential. When laser light emitted from the scanner unit 6 irradiates selective portions on the surface of the photosensitive drum 25, electric potential of the charge at the irradiated positions drops, thereby forming an electrostatic image on the surface of the photosensitive dram 25. Friction at the toner supply roller 31 and the developing roller 27, for example, charges toner to the same polarity as the electric potential of the electrostatic image. The charged toner electrically clings to the electrostatic latent image, thereby developing the electrostatic latent image.

The visible toner image formed by toner clinging to the surface of the photosensitive drum 25 is transferred onto the sheet P by the transfer roller 28. Afterward the sheet P is transported to the fixing unit 8. Next, toner remaining on the surface of the photosensitive drum 25 is electrically removed from the surface of the photosensitive drum 25 by the cleaning roller 29 and temporarily supported on the surface of the cleaning roller 29. At times when no sheet P is being transported past the photosensitive drum 25, the cleaning roller 29 is charged with a voltage of polarity opposite that required to electrically remove toner from the surface of the photosensitive drum 25. This develops an electric field between the photosensitive drum 25 and the cleaning roller 29 in the direction opposite that for attracting toner from the surface of the photosensitive drum 25 to the cleaning roller 29 removes. As a result, toner clinging to the surface of the cleaning roller 29 is returned to the surface of the photosensitive drum 25 following the direction of the electric field.

Toner returned to the surface of the photosensitive drum 25 from the cleaning roller 29 is transported on the surface of the photosensitive drum 25 to the developing roller 27, whereupon the developing roller 27 collects the toner and returns It to the developing chamber where it is reused. By repeating the above-described processes, images can be consecutively formed.

Next, an explanation for the charge unit 26 will be provided while referring to FIGS. 3 to 5. The charge unit 26 is a scorotoron type charge unit and includes a grid electrode 70, a charge wire 71, a charge unit casing 72, and a charge wire cleaner 73. The charge wire 71 is supported at its ends on the charge unit casing 72 applied with an appropriate tension. The grid electrode 70 is substantially C-shaped in cross section as viewed in FIG. 3. A portion of the grid electrode 70 serves as a shield of the charge unit 26. Although not shown in the drawings, a voltage source is provided for supplying current to the charge wire 71. When the charge wire 71 receives current from the voltage source, it experiences a corona discharge and charges the photoconductive layer on the surface of the photosensitive drum 25.

The charge wire 71 of the present embodiment is formed from a tungsten steel wire but could alternatively be formed from stainless steel wire, piano wire, steel wire, or carbon fiber wire. As shown in FIG. 4, the charge wire 71 has a length substantially equal to the length of the photosensitive drum 25. As shown in FIG. 5, the charge wire 71 includes a wire body 71A coated with a layer 82 including a binder 81 and particles 80. The particles 80 are uniformly dispersed in the binder 81, which serves as a dispersion medium for the particles 80, so that the particles 80 are uniformly distributed around the surface of the wire body 71A.

In the present embodiment, the particles 80 are particles of molybdenum disulfide and the binder 81 is a cellulose resin. However, the particles 80 can alternatively be particles of other conductive materials such as aluminum, carbon, or a phosphate precipitate. The particles 80 need not be dispersed in a dispersion medium, but could instead be sprinkled or sprayed directly on the wire body 71A. Further, other dispersion media than a cellulose resin can be used. For example, acrylic resin binder or a fat or oil-based medium such an grease can be used.

To produce the charge wire 71 shown in FIG. 5, the particles 80 and the binder 81 are mixed together in an ethyl acetate solution until the particles 80 are uniformly dispersed in the binder 81. Then, the binder 81 with the particles 80 dispersed therein is coated or sprayed on the surface of the wire body 71A to form a thin film coating on the surface of the wire body 71A.

The grid electrode 70 extends horizontally to a length substantially the same as the length of the charge wire 71 and to a predetermined width W shown in FIG. 3. The grid electrode 70 increases uniformity of discharge from the charge wire 71 to uniformly charge the surface of the photosensitive drum 25.

As shown in FIG. 3, the charge wire cleaner 73 is disposed on rails 76 and, as indicated by arrows B in FIG. 4, is movable following the length of the photosensitive drum 25 and the length of the charge wire 71. The charge wire cleaner 73 includes walls 78 and a pair of rubber resilient bodies 74 attached one to each of the walls 78. The walls 78 form a groove 77 at the upper portion of the charge wire cleaner 73. The pair of resilient bodies 74 are fitted in the groove 77 so as to sandwich the charge wire 71. Although not shown in the drawings, clearing members are adhered to side surfaces of the resilient bodies 74 confronting the charge wire 71. The cleaning members sandwich the charge wire 71 from either side and, via resilient force of the resilient bodies 74, apply an appropriate pressure on the charge wire 71.

With this configuration, the charge wire cleaner 73 is capable of sliding in a lengthwise direction of the charge wire 71 while sandwiching the charge wire 71. When the charge wire 71 is to be cleaned, the user manually slides the charge wire cleaner 73 along the length of the charge wire 71, thereby cleaning the charge wire 71. The charge wire cleaner 73 is slidingly moved along the lengthwise direction of the charge wire 71 while resilient force of the resilient bodies 74 applies an appropriate pressure to the charge wire 71 sandwiched between the clearing members. The charge wire cleaner 73 wipes off materials clinging to the charge wire 71.

FIG. 4 shown the charge wire cleaner 73 in its waiting position where it waits during printing operations. The charge wire cleaner 73 is supported at the waiting position during printing in order to avoid interfering with printing operations.

In order to clean the charge wire 71 using the charge wire cleaner 73, the user opens the top cover 10 at the front surface of the main case 2 and removes the process unit 7 from the main case 2. Then, the user slides the charge wire cleaner 73 in the direction indicated by the arrow B. This completes cleaning operations performed on the charge wire 71. After cleaning operations are completed, the user returns the process unit 7 to its position in the main case 2 and closes the top cover 10.

When the laser printer 1 is operated to print images on sheets P, the voltage source (not shown in the drawings) supplies current so that a high voltage develops between the grid electrode 70 and the charge wire 71 of the charge unit 26. As a result, a corona discharge occurs at the surface of the charge wire 71 so that the photoconductive layer on the surface of the photosensitive drum 25 is charged.

As image forming processes are repeatedly performed, products resulting from the discharge process cling to the surface of the charge wire. Substances clinging to the charge wire include mainly silicon. A portion of the silicon component clinging to the charge wire 71 is presumed to be from toner from the developing unit and rubber from developing roller 27 in the developing unit. Another portion of the silicon component is presumed to be from silicon used in the structure of the printer that has oxidized on the charge wire 71 by energy produced during discharge.

Material clinging to the surface of the charge wire 71 gradually increases as the laser printer 1 is repeatedly operated. With conventional charge wires, discharges occur when the combined diameter of a charge wire and material clinging to the charge wire reaches about two times the diameter of the charge wire alone. However, according to experiments performed by the present inventor, discharges do not occur even when the combined diameter of the charge wire 71 and material clinging to the charge wire 71 reaches about two times the diameter of the charge wire 71 alone.

In the experiments, a conventional printer printed 2,000 to 5,000 sheets consecutively before image quality was degraded by discharges and the like. On the other hand, the laser printer 1 including the charge wire 71 coated with molybdenum printed 9,000 to 10,000 sheets consecutively before image quality any discharges occurred.

Figure 6:
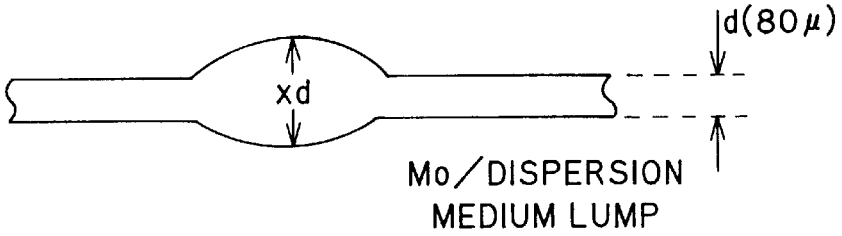
FIG. 6 is a schematic view showing charge wire used in experiments to determine desirable thickness of molybdenum coating on the charge wire.

The present inventor determined that the thicker the molybdenum coating, the better discharge can be prevented. Experiments were performed to determine effect of thickness of molybdenum/dispersion medium coating on charge developed by the charge wire. As shown in FIG. 6, a 80$\mu$ diameter tungsten steel wire was coated with molybdenum particles dispersed in cellulose resin. As shown in FIG. 6, the molybdenum/dispersion medium coating forms lumps on the charge wire. Next, a voltage was applied to the wire to develop a charge on a photosensitive drum confronting the wire. The voltage of charge developed was measured. This experiment was repeated with a variety of molybdenum/dispersion medium lumps having different thicknesses.

Figure 7:
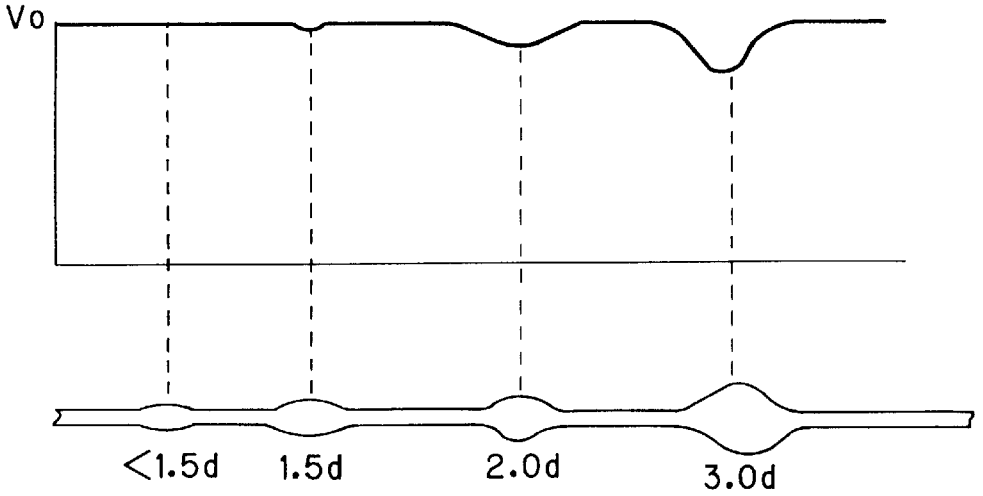
FIG. 7 is a schematic view showing relationship between thickness of molybdenum coating and fluctuation in resultant charge voltage.

FIG. 7 shows the experimentally determined relationship between electric potential formed on the surface of a photosensitive drum and lump diameter xd, i.e., lump thickness added to wire diameter. Charge developed by the charge wire changes depending on thickness of the molybdenum lump. The present inventor compared wire diameter d with lump diameter xd and determined that reduction in charge at lump diameter 2.0d, i.e., when lump diameter xd is twice the wire diameter d alone, is insufficient to adversely affect resultant images. It was further determined that reduction in charge at lump diameter 3.0d caused lines in printed sheets.

Therefore, it can be said that the drum's electric potential will not fluctuate and printing will not be defective as long as the diameter of the wire, that is, post-coating diameter, is less than twice the diameter of the wire before coating. Various method can be used to control the thickness of the coating liquid. For example, the coating thickness can be regulated by controlling the ambient temperature or humidity. Also, the duration of time that the coating material is sprayed on the wire, or the amount of time the wire is dipped in the coating material, can be adjusted to produce the desired coating thickness on the wire.

The charge wire 71 according to the present embodiment can generate a proper corona discharge with much less frequent long-term maintenance required than for conventional charge wires. The charge wire 71 need not be cleaned until a fairly long period has elapsed. Accordingly, when the photosensitive drum 25 has a relatively short operation life, the photosensitive drum 25 may become unusable before maintenance needs to be performed to clean the charge wire 71. In such cases, the charge wire cleaner 73 is unnecessary and can be dispensed with.

When the conductive particles are applied directly on the charge wire 71 without being dispersed in a dispersion medium or when the conductive particles are applied on the charge wire 71 using a fat or oil such as grease, it is desirable that the conductive particles only, or conductive particles dispersed in a grease, be supported on the resilient bodies 74 of the charge wire cleaner 73 so that when cleaning operations are performed, cleaning of the charge wire 71 and coating of the conductive particles can be performed at the same time. In this case, conductive particles will be supported on the charge wire 71 after cleaning operations.

While the Invention has been described in detail with reference to specific embodiments thereof, it would be apparent to those skilled in the art that various changes and modifications may be made therein without departing from the spirit of the invention, the scope of which is defined by the attached claims.

For example, in the present embodiment, the resilient bodies 74 in the cleaning members of the charge wire cleaner 73 sandwich the charge wire 71 from the left and right, that is, in the horizontal direction. However, the resilient bodies 74 and the cleaning members can sandwich the charge wire 71 from above and below or from any other angle.

Also, in the embodiment, the charge wire cleaner 73 is positioned in a waiting position at the ends of the charge wire 71 when printing is not performed. However, the charge wire cleaner 73 can be disposed at any position where it will not interfere with printing operations during normal printing.

Because conductive particles are applied to the surface of the charge wire body, arc discharges will not occur even when material clings to the charge wire in much larger amounts than would cause arc discharges in the conventional situation. Therefore proper corona discharge can be performed by the charge wire for longer periods between cleanings than in the conventional situation. Accordingly, the cycle of the charge wire maintenance and life of the charge wire can be greatly increased.

When the conductive particles are dispersed in a dispersion medium and coated on the surface of the charge wire, the charge wire can be produced with the conductive particles uniformly provided to the outer surface of the discharge wire so that high quality discharge wire can be easily obtained.

Molybdenum disulfide is a desirable material for use in producing the conductive particles because it is inexpensive and easily obtainable. The charge wire with molybdenum disulfide particles clinging to its outer surface can be inexpensively produced.

When a cellulose type or acrylic type resin, or a fat or oil, such as grease, is used as the dispersion medium, the conductive particles can be precisely uniformly dispersed and coating on the surface of the charge wire can be easily performed.

What is claimed is:

1. A charge wire comprising:

a charge wire body having an outer peripheral surface; and particles of a conductive material coated or sprayed on the outer peripheral surface of the charge wire body, to form a coating of particles without any subsequent processes, wherein the particles are formed from molybdenum disulfide.

2. A charge wire as claimed in claim 1, further comprising a layer of a dispersion medium clinging to the outer peripheral surface of the charge wire body, the particles being dispersed in the dispersion medium.

3. A charge wire as claimed in claim 2, wherein combined diameter of the charge wire body and the layer of the dispersion medium is equal to or less than two times the diameter of the charge wire body alone.

4. A charge wire as claimed in claim 2, wherein the dispersion medium is a cellulose type resin.

5. A charge wire as claimed in claim 4, wherein the particles are formed from molybdenum disulfide.

6. A charge wire as claimed in claim 2, wherein the dispersion medium is an acrylic type resin.

7. A charge wire as claimed in claim 2, wherein the dispersion medium is at least one of a fat and an oil.

8. A charge wire comprising:

a charge wire body having an outer peripheral surface; and particles of molybdenum disulfide provided to the outer peripheral surface of the charge wire body.

9. A method of producing a charge wire comprising the steps of:

dispersing particles of a conductive material in a dispersion medium; and coating the dispersion medium and the particles dispersed therein on an outer peripheral surface of a charge wire body, thereby completing production of the charge wire wherein the particles are formed from molybdenum disulfide.

10. A method as claimed in claim 9, wherein the step of dispersing includes dispersing particles of molybdenum disulfide in the dispersion medium.

11. A method as claimed in claim 9, wherein the step of dispersing includes dispersing the particles in a cellulose type resin.

12. A method as claimed in claim 11, wherein the step of dispersing includes dispersing particles of molybdenum disulfide in the cellulose type resin.

13. A method as claimed in claim 9, wherein the step of dispersing includes dispersing the particles in an acrylic type resin.

14. A method as claimed In claim 13, wherein the step of dispersing includes dispersing particles of molybdenum disulfide in the acrylic type resin.

15. A method as claimed in claim 9, wherein the step of dispersing includes dispersing the particles in at least one of a fat and an oil.

16. A method as claimed in claim 15, wherein the step of dispersing includes dispersing the particles in grease.

17. A method as claimed in claim 15, wherein the step of dispersing includes dispersing particles of molybdenum disulfide in the at least one of the fat and the oil.

18. A method as claimed in claim 9, wherein the step of coating includes spraying the dispersion medium and the particles therein on the outer peripheral surface of the charge wire body.

19. A charge device comprising:

a shield having an elongated shape substantially C-shaped in cross section and open at one side of the C shape;

a charge wire stretched taut within the shield following the elongated shape, the charge wire including:

a charge wire body having an outer peripheral surface; and particles of a conductive material provided to the outer peripheral surface of the charge wire body; and a cleaner supporting particles of the conductive material and that cleans the charge wire while simultaneously coating the outer peripheral surface of the charge wire body with particles of the conductive material.

20. A charge device as claimed in claim 19, further comprising a grid having control electrodes disposed at the open side of the shield.

21. A charge device as claimed in claim 19, the cleaner including:

resilient members sandwiching the charge wire therebetween; and cleaning members provided to the resilient members and in contact with the charge wire, the cleaning members being coated with particles of the conductive material.

* * * * *